United States Patent [19]

Branecky et al.

[11] 4,378,223

[45] Mar. 29, 1983

[54] WEB FOLDING APPARATUS

[75] Inventors: George N. Branecky, Bethel; Frank T. Roetter, Westport; Frank A. Oeschger, East Norwalk, all of Conn.

[73] Assignee: Pitney Bowes Inc., Stamford, Conn.

[21] Appl. No.: 188,174

[22] Filed: Sep. 17, 1980

[51] Int. Cl.[3] ..... B65H 45/22

[52] U.S. Cl. ..... 493/439; 493/446

[58] Field of Search ..... 493/439, 413, 446; 226/195

[56] References Cited

U.S. PATENT DOCUMENTS

| | | | |
|---|---|---|---|
| 2,619,057 | 11/1952 | Ellis | 493/439 X |
| 2,879,061 | 3/1959 | Alden | 226/195 |
| 3,147,009 | 9/1964 | Gram | 493/439 |
| 3,356,557 | 12/1967 | Enskat | 493/439 X |
| 4,097,039 | 6/1978 | Fischer | 493/413 X |

*Primary Examiner*—A. J. Heinz

*Attorney, Agent, or Firm*—Donald P. Walker; William D. Soltow, Jr.; Albert W. Scribner

[57] ABSTRACT

For use in combination with a machine for feeding a web of paper in a downstream path of travel, there is provided apparatus for folding an unfolded web of paper along its longitudinally-extending weakened fold line. The apparatus comprises a frame; a drag member attached to the frame so as to extend in frictional engagement with the unfolded web; a pair of parallel spaced rollers which are attached to the frame below the level of the drag member so as to extend at right angles to the drag member, such that an unfolded web may extend downwardly in its path of travel from said drag member to said upper roller and be folded between them and such that the folded web may threadably extend between the upper and lower rollers; and an output roller attached to the frame so as to extend parallel to said upper and lower rollers, such that the folded web may extend in its path of travel from beneath the lower roller to the output roller and then from beneath the output roller to the machine. In addition, there is provided an upright guide plate, which extends between the lower roller and output roller and at right angles to the same, and articulable structure which carries a wheel for disposition in rolling engagement with the fold line of a web between the drag member and said upper roller. The wheel is thus selectively positionable with respect to a web for urging the fold edge of a folded web into engagement with the guide plate as the machine feeds a web in its downstream path of travel.

2 Claims, 4 Drawing Figures

WEB FOLDING APPARATUS

BACKGROUND OF THE INVENTION

In the forms folding apparatus disclosed in U.S. Pat. No. 3,356,557 issued Dec. 5, 1967 to A. G. Enskat a web of paper is fed from a first roller to a second roller which is oriented at right angles to the first roller and spaced above the same. And, the web is folded in the course of traveling upwardly between the rollers although no controlling structure is provided to assist in the folding operation. In practice, it has been found that the lack of provision of such controlling structure militates against usage of the apparatus for folding webs of different widths and/or weights per unit lengths, for example under different environmental conditions, or for folding webs which include a weakened fold line which is not centrally located along the longitudinal length of the web. In addition, it has been found that even when some forms of web folding control structure are added to such apparatus, one or more of the aforesaid problems persist. On the other hand, it has been found that the aforesaid problems are to some extent alleviated when the aforesaid structure is modified such that rather than folding the web as it is being raised, from a lower roller to an upper roller, the web is folded as it is being lowered, provided the upper roller is converted to a drag member, and more particularly, to adjustable drag means. In addition, it has been found that when such modified structure is further improved to include fold assisting structure between the upper drag means and lower roller, the aforesaid problems are substantially eliminated. With the above thoughts in mind and with a view to substantially providing for guidance of the folded web as it exits the folding apparatus:

An object of the present invention is to provide web folding apparatus for use with a machine for feeding a folded web of paper;

Another object is to provide, for use with a web feeding machine, improved apparatus for folding an unfolded web along a longitudinally-extending weakened fold line; and Yet another object is to provide the aforesaid improved web folding apparatus with means for guiding the fold edge of a folded web in a downstream path of travel.

SUMMARY OF THE INVENTION

For use in combination with a machine for feeding a web of paper in a downstream path of travel, there is provided apparatus for folding an unfolded web of paper along a longitudinally-extending weakened fold line thereof, said apparatus comprising: a frame; web drag means including a drag member longitudinally extending across the path of travel of an unfolded web for frictional engagement thereby; upper and lower parallel-spaced rollers, rotatably attached to the frame below the level of the drag member so as to extend at right angles to the drag member such that an unfolded web may extend downwardly from said drag member to said upper roller and be folded therebetween and such that said folded web may threadably extend between said upper and lower rollers and into engagement therewith; an output roller rotatably attached to the frame so as to extend parallel to said rollers such that said folded web may extend from beneath said lower roller to said output roller and into engagement therewith; and web guide means including an upright guide plate attached to said frame so as to extend between said lower roller and output roller and at right angles with respect to the axis thereof, said web guide means including elongated articulable means having one end fixedly attached to said frame, said guide means including a wheel rotatably attached to the other end of said articulable means for disposition in rolling engagement with the fold line of a web between said drag member and said upper roller. The articulable means including means for selectively positioning said wheel with respect to a web for urging the fold edge of a folded web into engagement with said guide plate as said machine feeds the web in said downstream path of travel.

BRIEF DESCRIPTION OF THE DRAWINGS

As shown in the drawings wherein like reference numerals designate like or corresponding parts throughout the several figures.

DESCRIPTION OF THE PREFERRED EMBODIMENT

Figure 1:
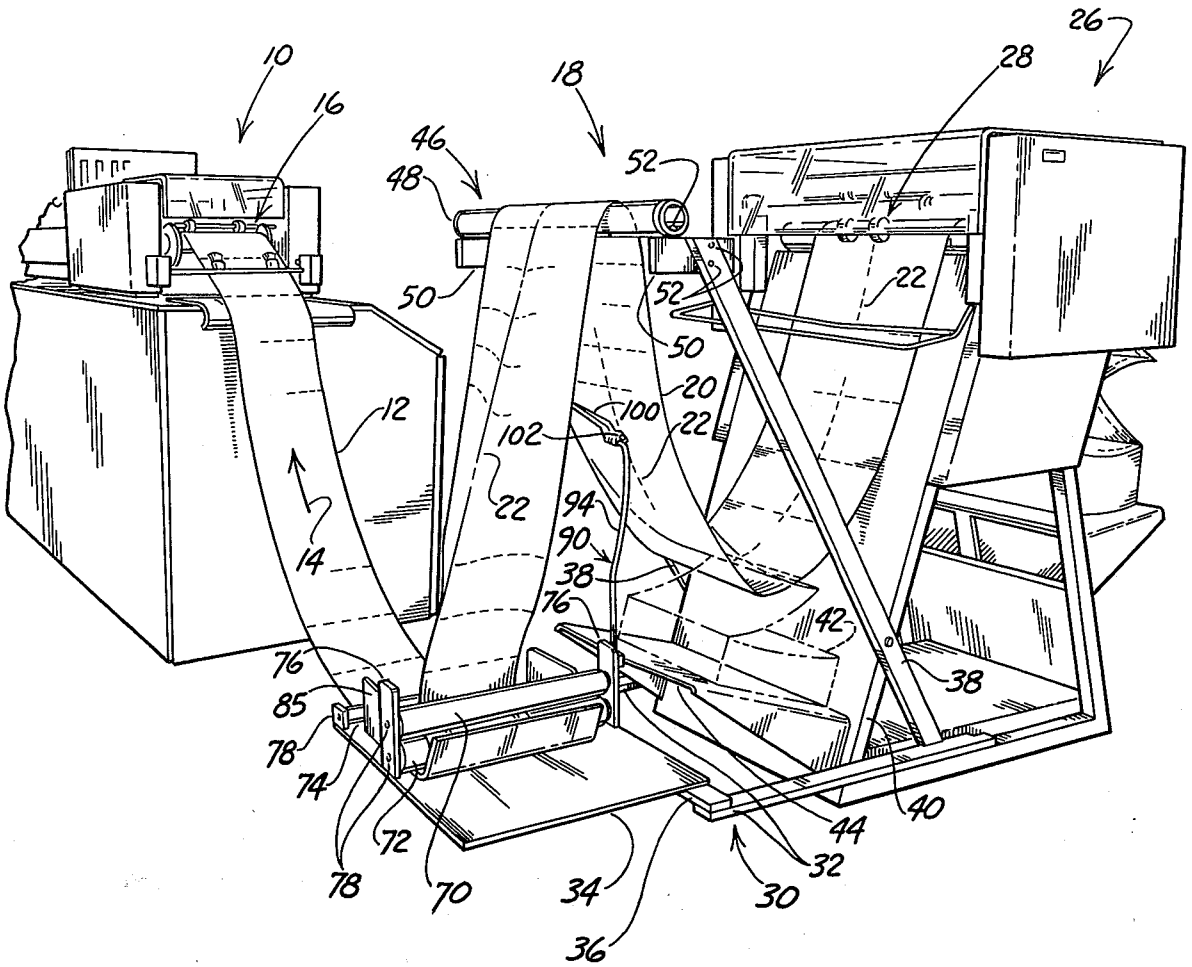
FIG. 1 is a perspective view of the web folding apparatus, according to the invention, shown in combination with a conventional machine for feeding a web through the apparatus.

As shown in FIG. 1, a business machine 10 of the type which performs work operations on a folded web 12 of paper, as the web is fed in a downstream path of travel 14, may comprise a burster-folder. And, such machines 10 generally include conventional means 16 for intermittently feeding the folded web 12 in the downstream path of travel 14. According to the invention there is provided, for use with the such machines 10, apparatus 18 for folding an unfolded web 20 of paper, such as a computer form, along its longitudinally-extending weakened fold line 22. In practice, the weakened fold line 22 is preferably a perforated line formed in the web 20 by a conventional device 26 having well-known structure 28 for forming the weakened fold line 22.

The folding apparatus 18 (FIG. 1) comprises a suitable frame 30 for supporting the various web handling components of the apparatus 18. To that end, the frame 30 includes a pair of parallel-spaced base legs 32, and includes a base plate 34 which is fixedly attached to the base legs 32 as by means of a base strut 36. In addition, the frame 30 includes a pair of parallel-spaced upright struts 38, having their lower ends conventionally fixedly attached to the base legs 32 on a one-for-one basis. To facilitate associating the apparatus 18 with a perforating device 26, the frame 30 may additionally include an upright web guide wall 40, which is conventionally fixedly attached to the frame's base legs 32 and to the frame's upright struts 38 so as to extend high enough upwardly to afford for guidance of the unfolded web 20 as it is fed from the perforating device 26. On the other hand, the folding apparatus 18 may also be used for folding a paper web 20 as it is fed from a fan-folded stack 42, without associating the apparatus 18 with a perforating device 26, it being assumed that the web 20 in the stack 42 has already been provided with a weakened fold line 22. To that end, the frame 30 may, in lieu of the higher guide wall 40, include a shorter upright guide wall 40, which preferably extends upwardly from the base legs 30 a sufficient distance to be affixed to the upright struts 38 for structural rigidity. And, for supporting the fan-folded stack 42, the frame 30 would then additionally include a conventional plate 44 which is suitably fixedly attached to the struts 38 so as to provide a platform on which the fan-folded web stack 42 may be loaded for feeding therefrom by the machine 10.

Figure 2:
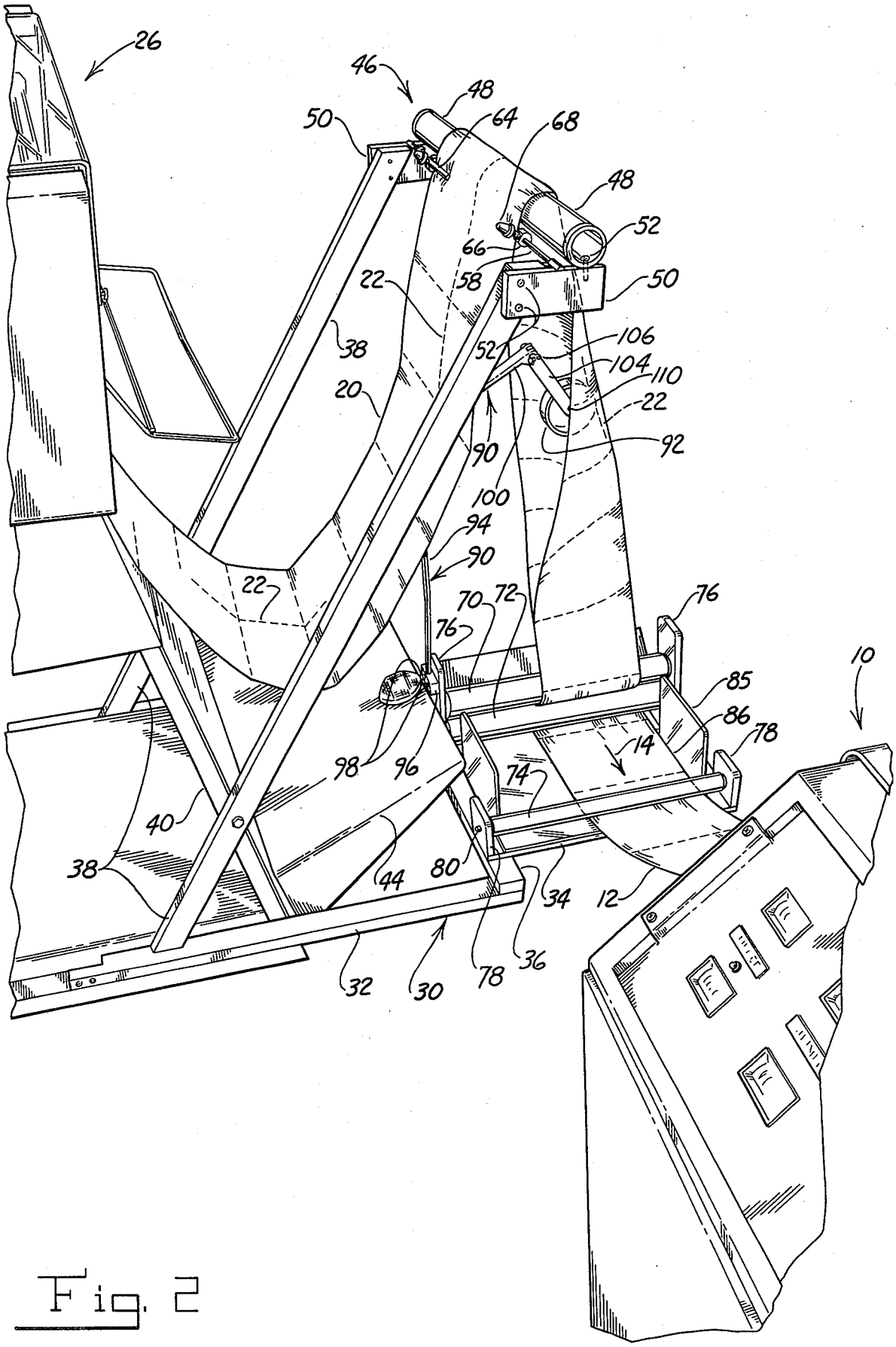
FIG. 2 is an enlarged, fragmentary, side perspective view of the web folding apparatus of FIG. 1, showing the downstream path of travel in which the web is fed through the apparatus.
Figures 3, 4:
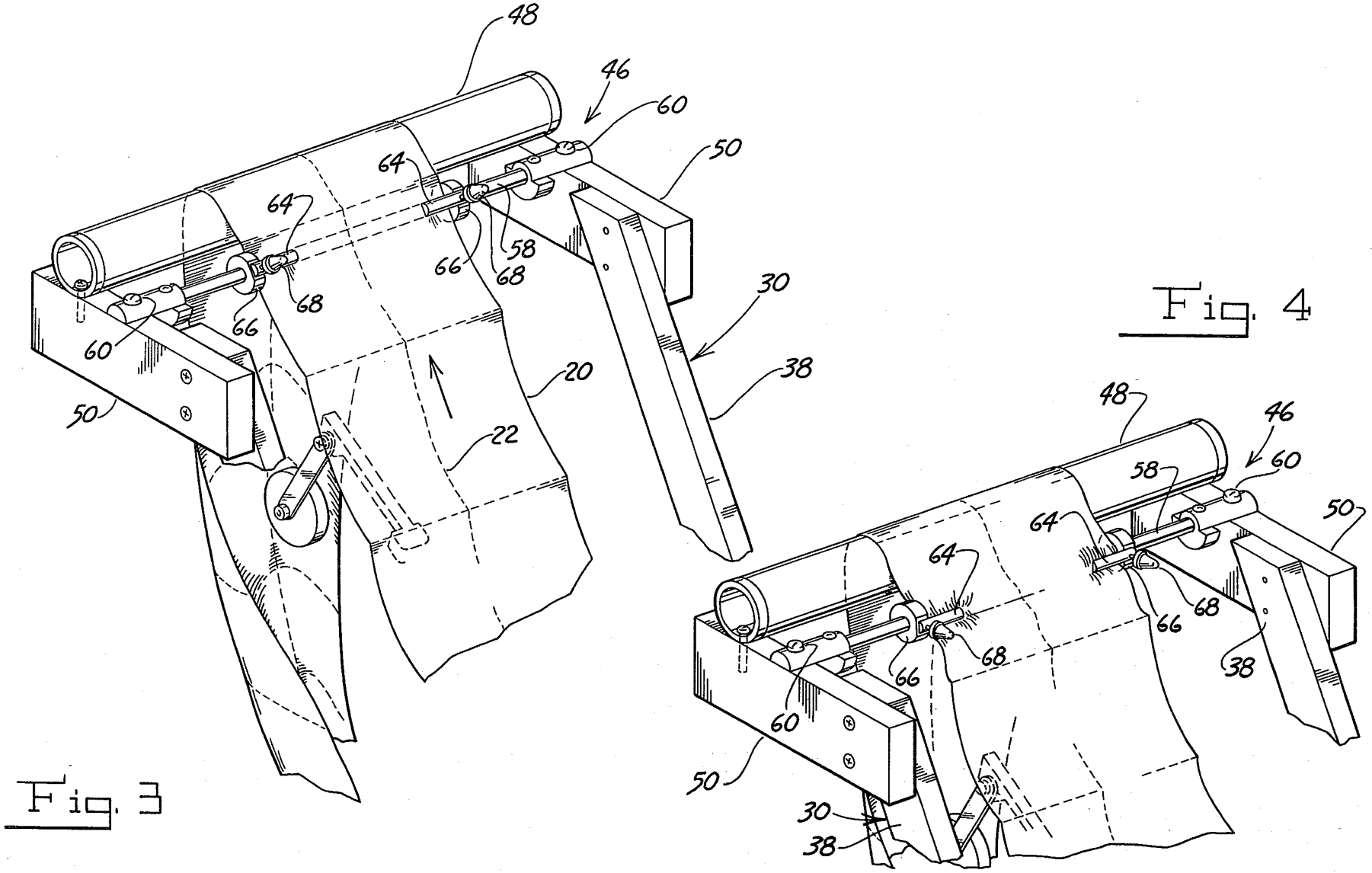
FIG. 3 is an enlarged, fragmentary, side perspective view of the web drag means of the apparatus, showing the drag means adjusted for web guidance purposes.
FIG. 4 is a view similar to FIG. 3, showing the web drag means adjusted for increased frictional engagement between the web and web drag means.

For web handling purposes the folding apparatus 18 (FIG. 1) is provided with web drag means 46, including an elongated drag member 48 which is conventionally fixedly attached to the frame 30, as by means of a pair of parallel-spaced arms 50 which are suitably fixedly attached to both the frame's upright struts 38 and to the opposite ends of the member 48, as by means of a plurality of fasteners 52 (FIG. 2). The drag member 48 is preferably an elongated member having an upper, curvedly-extending exterior surface, such as the tube which is shown. The drag member 48 extends across the path of travel of the unfolded web 20 for frictional engagement thereby. To adjust the extent of frictional engagement of the unfolded web 20 with the web drag means 46, the drag means 46 (FIG. 3) additionally includes an elongated guide bar 58. The guide bar 58 is conventionally fixedly attached to the frame 30, as by means of fasteners 60 which attach the opposite ends of the bar 58 to the arms 50, so that the bar 58 longitudinally extends parallel to the drag member 48 and upstream thereof in the path of travel of the unfolded web 20. In addition, for adjusting the extent of frictional engagement of the unfolded web 20 with the drag member 48, the web drag means 46 includes a pair of finger members 64. Each of finger members 64 is conventionally adjustably fixedly attached to the guide bar 58, for rotating the fingers 64 into and out of engagement with the outer surface of the unfolded web 20. To that end, each of the fingers 64 is fixedly attached to a collar 66 which is, in turn, conventionally adjustably rotatably attached, as by means of a thumb screw 68, to the guide bar 58. Accordingly, if it is desirable to reduce the extent of frictional engagement between the unfolded web 20 and drag member 48, the finger members 64 may be rotated counter-clockwise, to for example the position as shown in FIG. 3, for moving the finger members 64 out of engagement with the web 20; in which instance the finger members 64 provide for guidance of the web 20 in its path of travel toward the drag member 48, but do not to any significant extent exert a frictional drag force on the unfolded web 20. On the other hand, for incrementally increasing the extent of frictional engagement between the web 20 and drag member 48, and between the web 20 and guide bar 58, and between the web 20 and finger members 64, the finger members 64 may be rotated to a greater or lesser extent clockwise as shown in FIG. 4.

For web handling purposes, the folding apparatus 18 (FIG. 1) additionally includes an upper roller 70, a lower roller 72 and an output roller 74. The rollers 70 and 72 are vertically spaced parallel with respect to each other and respectively conventionally rotatably attached to the frame 30, as by means of a suitable pair of parallel-spaced upright brackets 76, which are affixed to the frame's base plate 34, and a suitable pair of pivot pins 78 supported by the brackets 76. The respective rollers, 70 and 72, longitudinally extend across the path of travel of the folded web 12 and at right angles with respect to longitudinal length of the drag member 48. The output roller 74 is spaced parallel with respect to the lower roller 72 and conventionally fixedly attached to the frame 30, as by means of an additional pair of parallel-spaced upright brackets 78 (FIG. 2), which are suitably affixed to the frame's base plate 34, and an additional pivot pin 80.

The unfolded web 20 (FIG. 1) extends from the fold line perforating device 26 or upwardly from web stack 42, as the case may be, into engagement with the drag member 48 and over the upper, curvedly-extending surface of the drag member 48. The web 20 (FIG. 2) then extends downwardly from the drag member 48 to the upper roller 70. Before engaging the upper roller 70 the unfolded web 20 is folded along its longitudinally-extending weakened fold line 22. The folded web 12 is then looped about the downstream side of the upper roller 70, threaded between the upper and lower rollers, 70 and 72, and looped about the upstream side of the lower roller 72. The folded web 12 then extends downstream in its path of travel from beneath the lower roller 72 to the output roller 74. And, as best shown in FIG. 2, the folded web 12 is then looped beneath the output roller 74 and gradually extends upwardly from engagement with the output roller 74 to the machine 10.

To facilitate guiding the folded web 12 out of the apparatus 18 (FIG. 1), the apparatus 18 includes an upright guide plate 85. The plate 85 (FIG. 2) is conventionally fixedly attached to the frame 30, as by suitably fastening the same to the frame's base plate 34. The plate 85 longitudinally extends between the lower roller 72 and output roller 74 and acts as a wall against which the fold edge 86 of the folded web 12 may be urged for guidance thereby. To further facilitate guiding the folded web 12 out of the apparatus 18, and to additionally guide the unfolded web 20 into its folded condition, the apparatus 18 includes elongated articulable means 90 and a wheel 92 carried thereby.

The aforesaid articulable means 90 (FIG. 1) includes a substantially vertically extending base leg 94, which has its lower end conventionally fixedly attached to the frame 30, as by means of a suitable block 96 (FIG. 2) and associated fasteners 98. The block 96, and thus the lower end of the leg 94, is preferably attached to the bracket 76 which is located next adjacent to the perforating device 26 or fan-folded stack 42 (FIG. 1), as the case may be. The articulable means 90 also includes an elongated arm 100 which is conventionally adjustably fixedly attached to the upper end of the leg 94, as by means of a threaded fastener 102, so as to extend toward the web's weakened fold line 22 and into its path of travel between the drag member 48 and upper roller 70. In addition, the articulable means 90 includes an elongated finger 104 (FIG. 2) which is conventionally adjustably fixedly attached to the arm 100, as by means of a threaded fastener 106, so as to depend from the arm 100. The wheel 92 is conventionally rotatably attached to the lower end of the finger 104, as by means of a pivot pin 110. With this arrangement, the articulable means 90 may be adjusted for selectively positioning the wheel 92 with respect to the web and into rolling engagement with the weakened fold line 22 of the web, between the drag member 48 and upper roller 70, to facilitate folding the web along its weakened fold line 22 and also for urging the fold edge 86 of the folded web 12 into engagement with the guide plate 85 as the machine 10 feeds the folded web 12 in its downstream path of travel 14. To still further facilitate guidance of the folded web 12, the collars 66 (FIGS. 2 and 3) which adjustably fixedly attach the finger members to the guide bar 58 are slidably as well as rotatably mounted on the guide bar 58, as a result of which the collars 66 and thus the finger members 64 are connected to the frame 30 for movement toward and away from each other and, therefore, into and out of engagement, on a one for one basis, with the opposed edges of the unfolded web 20. With this arrangement, the unfolded web 20 may be appropriately located lengthwise of the drag member 48 to facilitate properly locating the fold edge 86 (FIG. 2) of the folded web 12 lengthwise of the upper and lower rollers, 70 and 72; as a consequence of which the collars 66 and finger members 64 cooperate with the wheel 92 for urging the fold edge 86 of the folded web 12 into proper engagement with the guide plate 85.

In accordance with the objects of the invention there has been described a web folding apparatus for use in combination with a machine for feeding a web.

Inasmuch as certain changes may be made in the above described invention without departing from the spirit and scope of the same, it is intended that all matter contained in the above description or shown in the accompanying drawings shall be interpreted in an illustrative rather than the limiting sense. And, it is intended that the following claims be interpreted to cover all the generic and specific features of the invention herein described.

What is claimed is:

1. For use in combination with a machine including means for feeding a web of paper in downstream path of travel, wherein said web has opposed surfaces and opposed edges, apparatus for folding an unfolded web of paper along a longitudinally-extending weakened fold line thereof and forming a fold edge defined by said fold line, said apparatus comprising:

(a) a frame;

(b) means for exerting frictional drag on a web, said web drag means including an elongated drag member fixedly attached to the frame at a predetermined level thereof and longitudinally extending across the path of travel of an unfolded web for frictional engagement thereby;

(c) an upper roller and a lower roller, said rollers being spaced parallel with each other and respectively rotatably attached to the frame below the level of the drag member, said rollers extending at right angles to the drag member such that an unfolded web may extend downwardly in the path of travel from said drag member to said upper roller and be folded therebetween and such that said folded web may threadably extend in the path of travel between said upper and lower rollers and into engagement therewith;

(d) an output roller, said output roller rotatably attached to the frame and extending parallel to said upper and lower rollers such that said folded web may extend in the path of travel from beneath said lower roller to said output roller and into engagement therewith and such that said folded web may extend upwardly in the path of travel from beneath said output roller to said machine;

(e) web guide means including an upright guide plate attached to said frame and extending between said lower roller and said output roller and at right angles with respect to the axis thereof, said web guide means including a wheel and elongated articulable means for supporting said wheel, said articulable means having opposite ends, one of said ends being fixedly attached to said frame, said wheel rotatably attached to the other of said ends of said articulable means for disposition in rolling engagement with the fold line of a web in the path of travel between said drag member and said upper roller, said articulable means including means for selectively positioning said wheel with respect to a web for urging the fold edge of a folded web into engagement with said guide plate as said machine feeds a web in said downstream path of travel; and (f) said guide means including means cooperative with said guide plate for guiding the opposed edges of an unfolded web, said guide means including means cooperative with said drag member for adjusting frictional engagement of an unfolded web with said drag means, said means for adjusting web engagement including a pair of web engaging fingers adjustably attached to said frame for urging the fingers into and out of engagement with one of the surfaces of an unfolded web, and said opposed edges guiding means including said finger members being adjustably attached to the frame for movement toward and away from each other and into engagement on a one for one basis with the opposed edges of an unfolded web.

2. The apparatus according to claim 1, wherein said means for adjusting web engagement includes an elongated guide bar fixedly attached to said frame and longitudinally extending parallel to the drag member and upstream thereof in said path of travel.

* * * * *

UNITED STATES PATENT AND TRADEMARK OFFICE

CERTIFICATE OF CORRECTION

PATENT NO. : 4,378,223

DATED : September 17, 1980

INVENTOR(S) : George N. Branecky, Frank A. Oeschager, Frank Rotter

It is certified that error appears in the above-identified patent and that said Letters Patent are hereby corrected as shown below:

Column 1, line 34, change"substantially" to -- additionally --

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*